United States Patent [19]

Marshall

[11] Patent Number: 4,796,813

[45] Date of Patent: Jan. 10, 1989

[54] VISCOUS FLUID SPRAYING APPARATUS HAVING A UNITARY NOZZLE

[75] Inventor: Lee Marshall, Santa Cruz, Calif.

[73] Assignee: Slautterback Corporation, Monterey, Calif.

[21] Appl. No.: 161,310

[22] Filed: Feb. 23, 1988

Related U.S. Application Data

[63] Continuation of Ser. No. 941,859, Dec. 15, 1986, abandoned.

[51] Int. Cl.[4] ..... B05B 7/06; B05B 1/14; B05B 1/30

[52] U.S. Cl. ..... 239/425; 239/536; 239/551; 239/558; 239/582.1

[58] Field of Search ..... 239/418, 424, 424.5, 239/425, 536, 551, 582.1, 558, 82, 397, 433

[56] References Cited

U.S. PATENT DOCUMENTS

| | | | |
|---|---|---|---|
| 1,082,314 | 12/1913 | Gabrys | 239/82 X |
| 2,230,609 | 2/1941 | Cannon | 239/536 X |
| 2,750,997 | 6/1956 | Reuter | 239/536 X |
| 2,895,684 | 7/1959 | Harr | 239/418 X |
| 3,019,993 | 2/1962 | Hoover | 239/536 X |
| 3,348,520 | 10/1967 | Lockwood | 118/2 |
| 3,515,354 | 6/1970 | Presson | 239/582.1 |
| 3,923,248 | 12/1975 | Cresswell | 239/424 |
| 4,031,854 | 6/1977 | Sprague, Jr. | 118/641 |
| 4,065,057 | 12/1977 | Durmann | 239/79 |

FOREIGN PATENT DOCUMENTS

| | | | |
|---|---|---|---|
| 2364556 | 7/1975 | Fed. Rep. of Germany | 239/424.5 |
| 831370 | 9/1979 | U.S.S.R. | 239/82 |

*Primary Examiner*—Andres Kashnikow
*Assistant Examiner*—Patrick M. Burkhart
*Attorney, Agent, or Firm*—Thomas Schneck

[57] ABSTRACT

An apparatus for dispensing viscous fluid material having one-piece nozzles which produce a supply of drops of fluid material. The nozzles each include a nozzle body having a first end and a dispensing end. A gas flow path through the nozzle body has an array of outlet sections which terminate at the dispensing end of the nozzle body. The inlet section of the gas flow path is a cylindrical bore which feeds a stream of gas to each of the outlet sections. A plurality of viscous fluid material passageways closely surround the outlet sections of the gas flow path. As a stream of material is discharged from each material passageway, the expansion of gas emerging from the gas outlet sections breaks up the flowing material, thereby applying the material in a spray of droplets even though both the gas flow and material flow are continuous. The first ends of nozzles are attached to an elongated dispensing bar of an applicator. The dispensing bar has a first longitudinal bore which is supplied with low pressure viscous fluid material and which is in fluid communication with the material passageways. The dispensing bar also has a second longitudinal bore which is supplied with a gas, preferably air, and which is in fluid communication with the inlet section of the gas flow path. Each nozzle is associated with a pair of screws which penetrate the dispensing bar and selectively restrict the gas flow and the material flow to the associated nozzle.

17 Claims, 3 Drawing Sheets

VISCOUS FLUID SPRAYING APPARATUS HAVING A UNITARY NOZZLE

This is a continuation of co-pending application Ser. No. 941,859, filed on Dec. 15, 1986, now abandoned.

DESCRIPTION

1. Technical Field

The present invention relates to apparatus for the dispensing of viscous fluid materials and in particular to apparatus for the low pressure sputtering of thermoplastic adhesive material and the like.

2. Background Art

Hot-melt adhesives are used in the automated packaging industry for sealing cases and cartons. Usually, melted adhesive is extruded under high pressure through a nozzle, the adhesive being applied to upper and lower major and minor flaps of cartons in long continuous strips. The use of high pressure to force hot-melt adhesives through nozzle orifices presents an occupational risk, since a rupture in the equipment could spray hot material in any direction. Further, utilization of high pressure equipment can be expensive. The expense of pressure resistant hoses, fittings and couplings could be eliminated if nozzle performance, using low pressure apparatus, could equal that produced with high pressure equipment. Much attention has been devoted to improving dispensing nozzles so as to provide adequate adhesive flow at lower pressures, as well as eliminating tailing, stringing, drooling, dripping and clogging between applications.

It has been realized that continuous strips of hot-melt adhesive represent a considerable use of material. One solution is to produce a series of short dots instead of a continuous strip. In U.S. Pat. No. 3,348,520, Lockwood discloses an apparatus which produces dots of hot-melt by opening and closing valves in the nozzles at a high cycling rate. Valves in the dispensing head are responsive to the alternating high pressure stroke and suction stroke of a pump. The valve in each nozzle also ensures clean sharp closure of the nozzles, thereby preventing any tendency towards dripping. Typically, cartons in an automated assembly line travel past the hot-melt adhesive dispenser at a rate of about 400 to 600 feet per minute. The rapid and repeated opening and closing of the valves, which is required to produce short adhesive dots, is hard on the seats and valves.

In U.S. Pat. No. 4,031,854, Sprague, Jr. teaches a method in which adhesive is extruded as a band of overlapping loops. A jet providing a gas stream has a rotational component causing swirling of the extruded adhesive filament. The gas stream should be heated to about 100° F., the nozzle should be within three inches from the application surface, and the supply rate of fluid adhesive should be such that the filaments are at least two mil in diameter. Otherwise, the adhesive may harden, either before it reaches the application surface, causing stringing, or before the surfaces to be adhered are pressed together.

In U.S. Pat. No. 4,065,057, Durmann teaches an apparatus for spraying powdered heat responsive material, such as resin. The material is then melted by heated compressed air downstream of and away from the nozzle. This approach prevents problems, such as powder clumping, associated with apparatus which heat the material prior to being discharged from the nozzle.

Nozzle assemblies which spray melt materials have had limited success. Prior art units need to be about six inches from the application surface for proper spray formation, especially when the generally viscous hot-melt adhesives are used. However, at this distance the melt materials may cool and harden in ambient air before reaching the application surface. At low pressures, inadequate flow and improper spray formation, including misting, may occur. Misting, i.e., the production of extremely fine droplets of melt material, is undesirable for some applications, such as the sealing of cartons.

It is an object of the present invention to produce dispensing apparatus for hot-melt material which operates at low pressures and whcih results in a considerable saving of the amount of hot-melt material used.

It is another object of the present invention to produce a dispenser, especially for sealing boxes, which can sputter preheated hot-melt adhesive onto a surface without stringing, misting or premature hardening of the material.

DISCLOSURE OF THE INVENTION

The above objects have been met with a viscous fluid material dispenser which produces a sputtering of drops of viscous fluid material onto surfaces at very close range without interruption valving or other pulsation means. The new apparatus has nozzles which can sputter drops of material at low pressure onto a surface only two or three inches away from the nozzle outlet. Proper breakup of fluid material is achieved in such short distances because a very fine stream of gas is combined axially within the fluid. As the fluid is propelled from a nozzle it is apparently broken up into large droplets by the expanding gas stream. Whereas prior art fluid material spray nozzles either rely on the shape of the nozzle orifice and ambient air to produce drops, or have one or more external air jets to break up fluid being dispensed from the nozzle, the gas stream used in the present invention is discharged from one or more gas passageways forming a set of inner flow paths and the fluid material is discharged from an outer flow path surrounding the gas flow path. Additionally, the nozzle of the present invention is a one-piece assembly, resulting in lower production costs and greater reliability.

The nozzle includes a nozzle body having a first end that is an inlet and a second end that is a dispensing end for the gas and the fluid material. The gas flow path has a cylindrical inlet section at the first end of the nozzle body. A plurality of outlet sections of the gas flow path extend from the inlet section to the second end of the nozzle body. The inlet section has an inner extremity that is conical so as to facilitate the movement of gas, preferably air, from the inlet section to the outlet section.

The nozzle further includes a plurality of fluid material passageways that start at the sides of the nozzle body and extend to the dispensing end of the nozzle body. The material passageways surround the outlet sections of the gas passageways. The emerging gas breaks up flowing material exiting from the dispensing end of the nozzle so that the emerging droplets appear to be deposited on a surface as by sputtering, even though both the gas flow and the fluid flow are continuous and not pulsed by valves or solenoids. When two or more gas passageways are present in a single nozzle, a wider spray pattern results, compared to nozzles with a single passageway. A square array of four passageways is shown.

In an embodiment involving a hot-melt applicator, the rearward ends of a plurality of the nozzles are attached to an elongated dispensing bar. The dispensing bar has a first longitudinal bore that is supplied with low pressure hot-melt material. The first longitudinal bore is in fluid communication with each of the material passageways of the nozzles. Each nozzle is associated with a screw which penetrates the dispensing bar and is disposed to selectively restrict the fluid communication of the first longitudinal bore with the associated nozzle. Such restriction is critical to applications having a large number of nozzles since the pressure of the hot-melt material will be less after the material passes each succeeding nozzle.

The elongated dispensing bar also has a second longitudinal bore, which is supplied with a gas, preferably air. The second longitudinal bore is in fluid communication with the inlet section of the gas flow path. Like the first longitudinal bore, a screw is disposed to selectively restrict the fluid communication of the second longitudinal bore with an associated screw. Thus, the pressure of the gas stream exiting the nozzles may be individually set.

The present invention has several advantages over prior art dispensers of thermoplastic material. Because a pattern of drops forms adjacent to the nozzles, instead of six inches away, the thermoplastic material does not cool before it reaches the application surface. Also, since the gas must work its way first through the dispensing head and then through the nozzle, the gas is heated substantially, thereby lessening the possiblity of the gas cooling the spray. Finally, lower gas and fluid material pressures are needed compared to sprayers with external air jets.

BEST MODE FOR CARRYING OUT THE INVENTION

Figure 3:
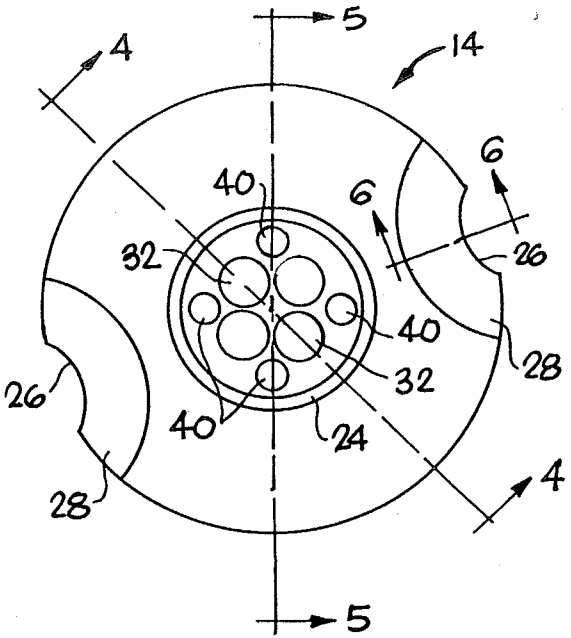
FIG. 3 is a front view of the nozzle of FIG. 1.
Figure 1:
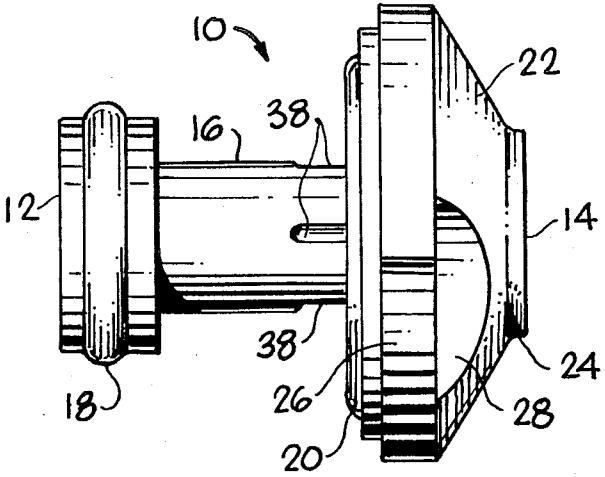
FIG. 1 is a perspective view of a nozzle in accordance with the present invention.
Figure 2:
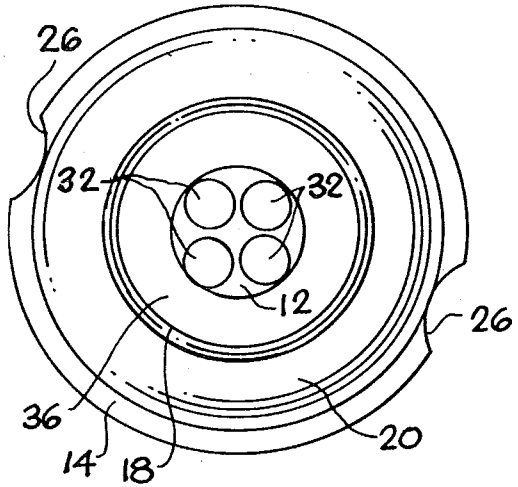
FIG. 2 is a rear view of the nozzle of FIG. 1.

With reference to FIGS. 1–3, a nozzle 10 has an inlet end 12, a dispensing end 14, and a tubular midportion 16. The nozzle has a one-piece construction, other than a rear O-ring 18 and a forward O-ring 20 which are employed to seal the nozzle 10.

The dispensing end 14 of the nozzle has a frustoconically sloped surface 22 which terminates in a short, cylindrical projection 24 in order to lessen the possibility of hot-melt material adhering to the dispensing end. While the invention is discussed with reference to spraying hot-melt material other thermoplastics and fluid could be similarly used. As will be shown below, the nozzle 10 is secured to a dispensing bar by two button head cap screws. For this reason, the nozzle has notches 26 which provide clearance for the threads of a screw, and the dispensing end 14 has indentations 28 for acceptance of the head of a screw.

Figure 4:
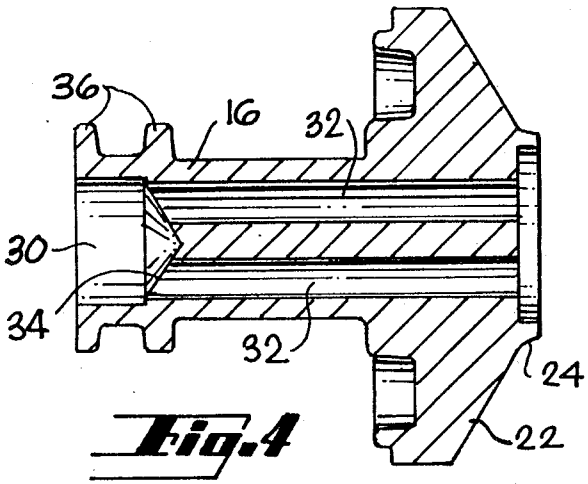
FIG. 4 is a sectional view of the nozzle of FIG. 3 taken along lines 4—4.

Referring now to FIGS. 2–4, the nozzle 10 has a gas flow path that is comprised of an inlet section 30 and a square array of four outlet sections 32. A stream of gas, preferably air, may be fed into the inlet section 30 for projection from the dispensing end 14 of the nozzle. The inlet section 30 has a conical extremity 34 leading to the connection of the inlet section with the outlet sections 32. Because the aggregate cross-sectional area of the outlet sections 32 is less than the cross-sectional area of the inlet section 30, the velocity of a given stream of gas will be increased as the stream of gas enters the outlet sections. Typically, the inlet section has a diameter of 0.12 inches and the outlet sections each have a diameter of 0.043 inches. This feature is not critical to proper operation of the nozzle, but the acceleration of the gas stream does aid in minimizing the required gas pressure that must be supplied to a nozzle in order to obtain the desired result.

The inlet end 12 of a nozzle includes a pair of flanges 36. The O-ring 18 is fitted between the flanges 36.

Figure 5:
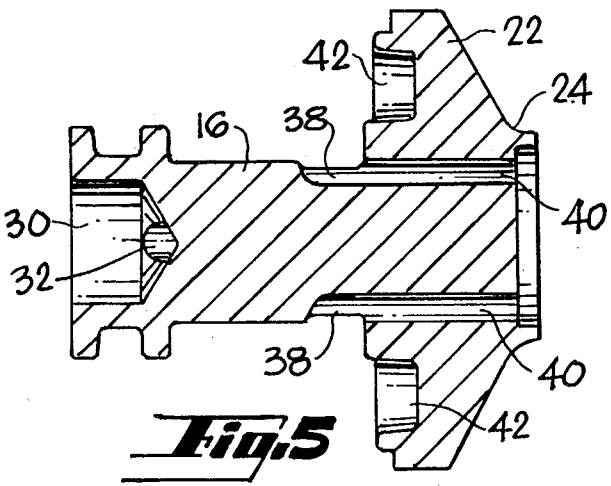
FIG. 5 is a sectional view of the nozzle of FIG. 3 taken along lines 5—5.

FIGS. 1, 3 and 5 illustrate a hot-melt material flow path. The midportion 16 of the nozzle has openings 38 which lead to a square array of four material passageways 40 that is offset from the square array of gas outlet sections 32 by forty-five degrees. While a square array is preferred, other geometrically regular arrays will work, such as at corners of a regular triangle or a regular pentagon. Each material passageway 40 is equidistant from a pair of adjacent outlet sections of the gas flow path. As hot-melt material is extruded from the material passageways 40, the expansion of the gas from the outlet sections 32 will force the hot-melt stream from each passageway outward, thereby producing a series of beads or droplets of hot-melt adhesive material.

Figure 6:
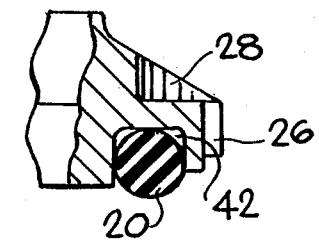
FIG. 6 is a partial sectional view of the nozzle of FIG. 3 taken along lines 6—6.

Referring now to FIGS. 5 and 6, the forward O-ring 20 is positioned within an annular slot 42. The O-ring seals the nozzle 10 so that hot-melt material will not flow from the edges of the nozzle.

Figure 8:
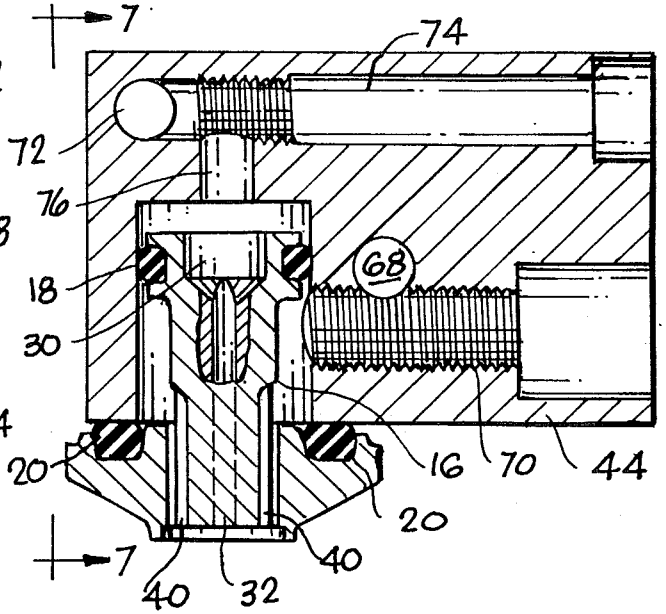
FIG. 8 is a side view of a nozzle of FIG. 7.
Figure 7:
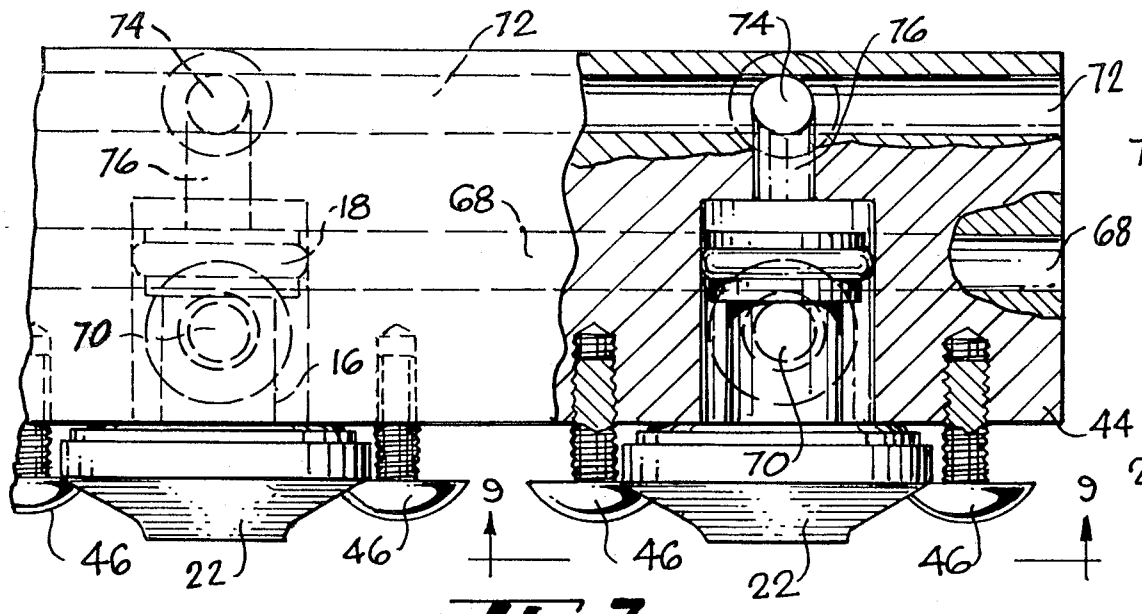
FIG. 7 is a front view of a pair of nozzles attached to a dispensing bar.
Figure 9:
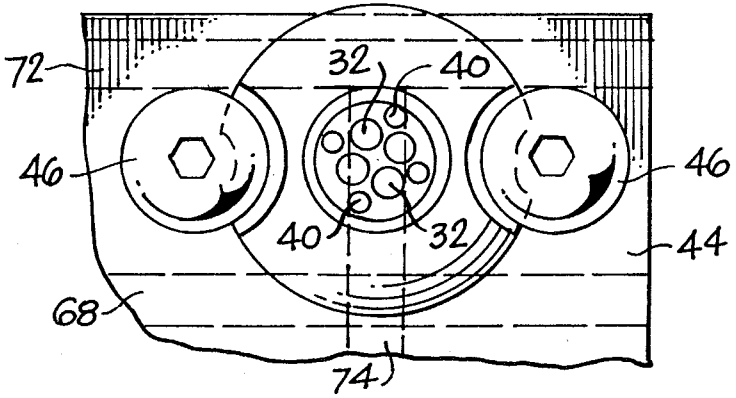
FIG. 9 is a bottom view of the nozzle attached to a dispensing bar taken along line 9—9.
Figure 11:
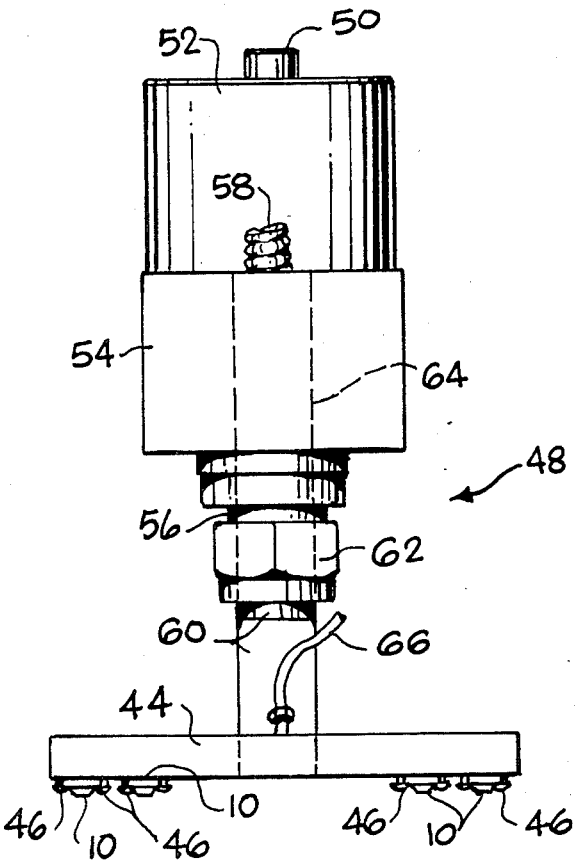
FIG. 11 is a front view of a nozzle manifold having a plurality of the nozzles shown in FIG. 1.

FIGS. 7–9 illustrate nozzles which are attached to a dispensing bar 44 of a hot-melt nozzle manifold. The nozzles are secured to the dispensing bar by a pair of hex head screws 46. FIG. 11 shows that the dispensing bar 44 is part of a nozzle manifold 48. Hot-melt adhesive material enters the nozzle manifold at a cylindrical inlet 50. The adhesive passes through a solenoid valve 52 and a heated dispenser head 54, after which the adhesive exits through an outlet 56. Dispenser heads are well known and are commercially available. The dispenser head 54 has heating elements which are supplied power by power line 58. The dispenser head shown is known as an D-100 head sold by Slautterback Corporation, Monterey, Calif.

An inlet section 60 of the nozzle manifold 48 has a hollow center bore, not shown, which is joined to the outlet 56 of the dispenser head by means of a swivel nut 62 in a direct hot-melt material dispensing line with the inlet 50 of the dispensing head. The swivel nut 62 allows tolerances for a leak-free attachment of the inlet section 60 to both the dispensor head 54 and to a heat transfer block 64, shown in phantom. An air tube 66 supplies a stream of gas to the dispensing bar 44. Preferably, the stream of gas enters the nozzle manifold 48 in a location that requires the gas to follow as much of the path followed by the hot-melt material as is possible. In this way the gas is heated prior to contact with the hot-melt material at the outlet of the nozzles 10.

Returning to FIGS. 7–9, the dispensing bar 44 has a first longitudinal bore 68 in fluid communication with the hot-melt adhesive path through the nozzle manifold. Upon reaching the location of a nozzle, hot-melt adhesive descends into a threaded bore 70 which provides hot-melt adhesive to the tubular midportion 16 of the nozzle. The adhesive then enters the material passageways 40 and is extruded from the dispensing end 14 of the nozzle.

A second longitudinal bore 72 receives a stream of gas from a gas supply. The stream of gas enters a partially threaded bore 74 associated with each nozzle, whereafter the gas descends into a vertical bore 76 for passage through the inlet section 30 and the outlet sections 32 of the nozzle's gas flow path.

Figure 10:
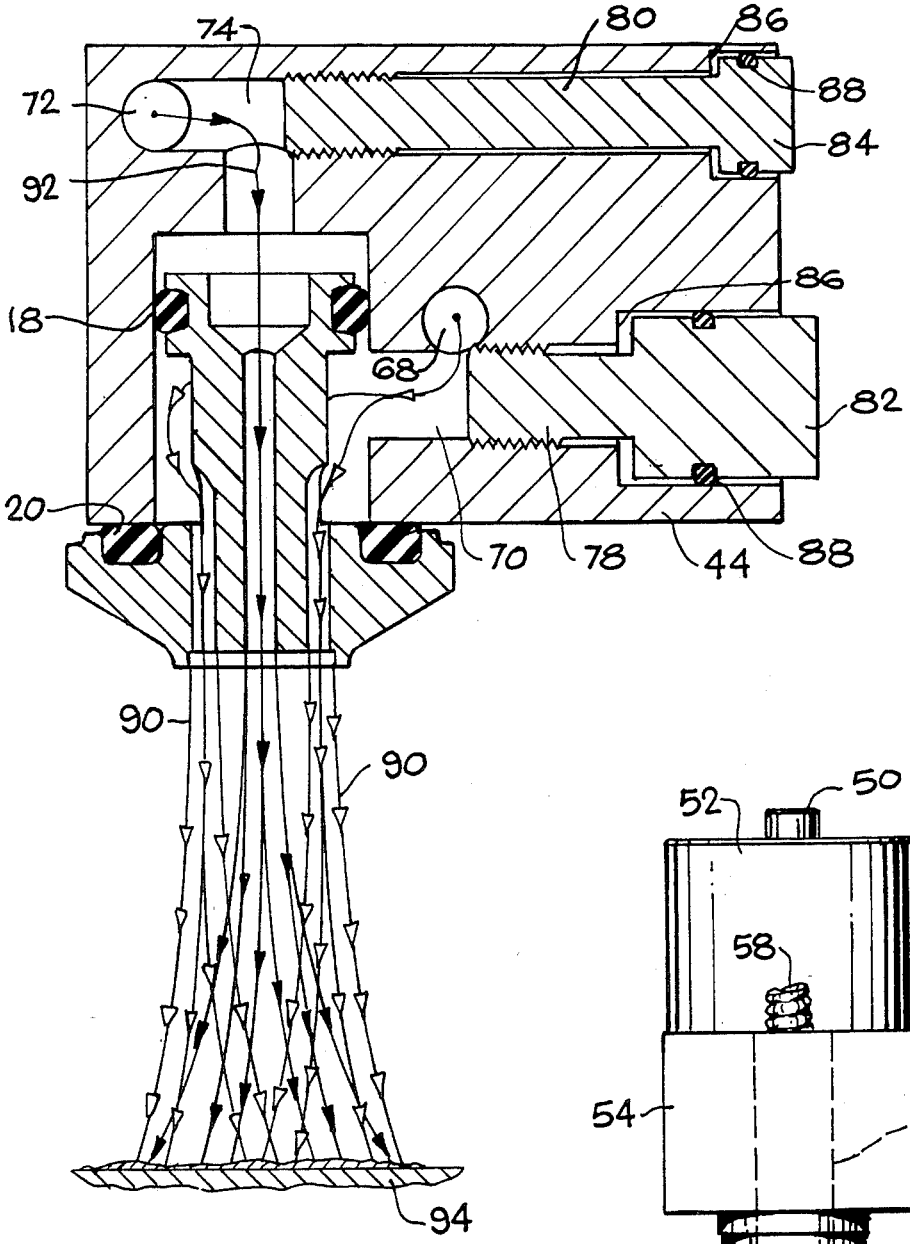
FIG. 10 is an operational view of the nozzle of FIG. 8.

As may be seen with reference to FIG. 10, the threaded bore 70 and the partially threaded bore 74 receive the ends 78 and 80 of screws 82 and 84. Rotation of screw 82 may be used to restrict the amount of hot-melt flow into the threaded bore 70, since the threaded end 78 of the screw will interfere with fluid communication between the first longitudinal bore 68 and the threaded bore 70. In a like manner, the screw 84 restricts the gas pressure to the nozzle associated with the screw. A method of regulating hot-melt material and gas pressure at individual nozzles is especially important in applications having a great number of nozzles, since pressure will decrease after material and gas are dispensed through each succeeding nozzle. Each bore 70 and 74 has a shoulder 86 and each screw 82 and 84 has an O-ring 88 to seal the bores, thereby preventing pressure leakage.

In operation, the flow path 92 of the gas is an inner flow path. That is, the gas flow path is surrounded by the outer, hot-melt material flow path 90. The rear O-ring 18 prevents communication of the two paths 90 and 92 prior to dispensation from the nozzle.

Upon discharge from the nozzle the gas flow 92 will expand, as seen in FIG. 10. The discharged streams of hot-melt material coaxially surround the gas flow path and, therefore, are forced outward. As a result the streams of hot-melt are applied to a surface 94 in a "stitch" pattern of drops, resembling sputtering deposition.

It is possible to control the size of the drops by adjusting the gas pressure to the nozzle relative to the pressure of hot-melt material. This may be done at the sources of the two fluids or by adjustment of the screws 82 and 84. Increasing the relative air pressure produces smaller drops. Preferably, drop size is adjusted to about one-eighth inch (3 mm).

The square arrays of material passageways 40 and outlet sections 32 of the gas passageway produce a wider deposition pattern than one produced by a nozzle having single openings. Wider patterns are preferred for sealing of surfaces in which maximum adhesive strength is desired with a minimum amount of material.

Nozzles 10 operate at low pressure, with hot-melt being at a pressure less than 150 pounds per square inch and the gas stream being at a pressure less than ten pounds per square inch. Preferably, air pressure is about three or four per square inch at the supply tank. Low pressure gas supply is possible since the gas flow path is an inner flow path. Additionally, because the gas flow path is through the dispensing bar 44, the gas is heated, thereby reducing the possibility of the gas significantly cooling the adhesive material before the material reaches the application surface.

I claim:

1. A nozzle system for spraying of viscous fluid material comprising:

a nozzle body having an axis, an outlet face at a forward end and two sets of passageways defined at least partially therethrough, including a first set of axially inward gas passageways and including a second set of viscous fluid passageways axially outward and spaced apart from but proximate to the first set of passageways, said fluid passageways disposed partialy coextensive and parallel to the first set of passageways at least closely adjacent said outlet face, said fluid passageways each terminating at the outlet face of the nozzle body, said gas passageways each having an outlet section extending at least to said outlet face, inert gas supply means in communication with said first set of axially inward gas passageways distal to said outlet face, and viscous fluid material supply means in communication with said second set of axially outward fluid passageways distal to said outlet face, whereby volumetric expansion of gas from said gas passageways into the ambient atmosphere at said outlet face breaks up and gives direction to viscous fluid material dispensed from said fluid passageways.

2. The apparatus of claim 1 wherein said nozzle is unitary, said first and second sets of passageways defined by bores extending through the nozzle.

3. The apparatus of claim 1 wherein each of said first and second sets of passageways is disposed in a geometrically regular array, one inside the other.

4. A nozzle system for spraying of viscous fluid material comprising, a nozzle body having a rearward inlet end and a forward dispensing end, said forward dispensing end having a dispensing face, an inner, gas flow path defined by at least one gas passageway through said nozzle body, each gas passageway having an outlet section extending to at least the dispensing face of the nozzle body, gas supply means in fluid communication with each gas passageway for projection of an inert gas from each outlet section at the dispensing end of the nozzle body, an outer, viscous fluid material flow path defined by a plurality of material passageways through said nozzle body, each material pasageway having an outlet portion extending substantially parallel to said outlet sections of the gas flow path but spaced apart therefrom, each material passageway having an inlet portion and having an outlet at said dispensing face of said nozzle body, and viscous fluid material supply means in fluid communication with the inlet portions of each material passageway for dispensing material from each outlet portion, whereby said material dispensed from said outlet portion is forced outwardly by volumetrically expansive flow of gas projected from the gas flow path.

5. The nozzle system of claim 4 wherein said gas flow path has a geometrically regular array of four outlet sections.

6. The nozzle system of claim 5 wherein said gas flow path includes an inlet section, said inlet section having a cross-sectional area greater than the aggregate cross-sectional area of said four outlet sections, said inlet section being in fluid communication with each outlet section.

7. The nozzle system of claim 5 having an array of four material passageways surrounding said geometrically regular array of outlet sections.

8. The nozzle system of claim 4 wherein each outlet section of the gas flow path is defined by a cylindrical wall and each material passageway is defined by a cylindrical wall.

9. The nozzle system of claim 4 wherein said gas is supplied at a pressure of approximately ten pounds per square inch.

10. The nozzle assembly of claim 4 wherein viscous fluid material from said material supply means is supplied at a pressure of approximately 150 pounds per square inch.

11. An apparatus for the breakup of viscous fluid material comprising, means for supplying viscous fluid material, an elongated dispensing bar attached to said means for supplying viscous fluid material, said dispensing bar having a first longitudinal bore in viscous fluid material transfer relationship with said means for supplying viscous fluid material, said dispensing bar having a second longitudinal bore, means for supplying an inert gas stream to said second longitudinal bore, a plurality of one-piece nozzles having a rearward end attached to said dispensing bar, said nozzles each having an axis and a forward end and having a plurality of first internal wall surfaces defining outlet sections of an axially inward gas flow path, each outlet section being in fluid communication with said second longitudinal bore and extending to the ambient atmosphere at the forward end, each nozzle further having a plurality of second internal wall surfaces axially outward of said first internal wall surfaces defining viscous fluid material passageways, each material passageway being in fluid communication with said first longitudinal bore and having an outlet to the nozzle exterior at the forward end of the nozzle, said material passageways at least partially surrounding, in spaced apart relation, said outlet sections of the gas flow path, whereby volumetric expansion of gas from said gas flow path breaks up material dispensed from said material passageways.

12. The apparatus of claim 11 further comprising first screw means for selectively restricting the fluid communication of said first longitudinal bore with said material passageways.

13. The apparatus of claim 12 wherein said screw means is a plurality of screws, each penetrating said dispensing bar and disposed so that rotation of a screw causes an end thereof to restrict the fluid communication between said first longitudinal bore and a nozzle associated with said screw.

14. The apparatus of claim 12 further comprising second screw means for selectively restricting the fluid communication of said second longitudinal bore with said gas flow path.

15. The apparatus of claim 14 wherein said screw means is a plurality of screws, each penetrating said dispensing bar and disposed so that rotation of a screw causes an end thereof to restrict the fluid communication between said second longitudinal bore and a nozzle associated with the screw.

16. The apparatus of claim 11 wherein said means for supplying viscous fluid and said means for supplying a gas stream each supply a constant pressure during dispensation of material from said material passageways.

17. The apparatus of claim 11 having a geometrically regular array of four outlet sections and having four material passageways, said material passageways surrounding said geometrically regular array of outlet sections but in proximity thereto.

* * * * *